US005720680A

United States Patent [19]

Mark

[11] Patent Number: 5,720,680

[45] Date of Patent: Feb. 24, 1998

[54] STRINGED RACKET TENSIONING MECHANISM

[76] Inventor: Eberhard von der Mark, Oberhombrechen 10, D-42499, Hückeswagen, Germany

[21] Appl. No.: 601,195

[22] Filed: Feb. 14, 1996

[30] Foreign Application Priority Data

Feb. 17, 1995 [DE] Germany ..... 195 05 480.6

[51] Int. Cl.[6] ..... A63B 51/12

[52] U.S. Cl. ..... 473/534; 473/539; 473/553

[58] Field of Search ..... 273/73 R, 73 D, 273/73 E, 73 G; 24/71 CT, 69 ST; 254/199; 242/147 R; 473/534, 553, 557, 546, 539

[56] References Cited

U.S. PATENT DOCUMENTS

| | | | |
|---|---|---|---|
| 3,837,649 | 9/1974 | Burchett | 273/73 A |
| 4,061,333 | 12/1977 | Shaps | 273/73 E |
| 4,099,717 | 7/1978 | Sacks | 273/73 E |
| 4,949,968 | 8/1990 | Korte-Jungermann | 273/73 A |
| 4,976,433 | 12/1990 | Pohlenz et al. | 273/73 E |
| 5,186,459 | 2/1993 | Korte-Jungermann | 273/73 A |
| 5,458,331 | 10/1995 | Bothwell . | |

FOREIGN PATENT DOCUMENTS

| | | | |
|---|---|---|---|
| 0 225 042 | 10/1986 | European Pat. Off. . | |
| 0225042 | 6/1987 | European Pat. Off. | 273/73 E |
| 3229981 | 2/1984 | Germany | 273/73 E |
| 38 13 872 C2 | 11/1989 | Germany . | |
| 38 18 152 A1 | 12/1989 | Germany . | |
| 39 17 868 C2 | 12/1990 | Germany . | |
| 8502294 | 3/1987 | Netherlands | 273/73 E |
| 1537280 | 1/1990 | U.S.S.R. | 273/73 E |
| 289297 | 7/1927 | United Kingdom . | |
| 2 252 505 | 2/1991 | United Kingdom . | |
| 2252505 | 8/1992 | United Kingdom | 273/73 E |

*Primary Examiner*—Raleigh W. Chiu
*Attorney, Agent, or Firm*—Foley, Hoag & Eliot LLP

[57] ABSTRACT

A mechanism for adjusting string tension of stringed rackets allows for increasing the tension of the racket strings without having to release the racket strings, without destabilizing the racket and without costly or troublesome aids. The tensioning mechanism includes an abutment piece and a tensioning piece. Strings of the racket pass through both pieces. The tensioning piece is lockable in varying positions to increase string tension. When the racket is strung, the mechanism can be arranged in a position of least tension. In that case, if the string tension declines, the tightening mechanism can be adjusted to a position of the next highest racket tension. Alternatively, the mechanism can be initially set to a medium tension setting and subsequently adjusted as appropriate.

25 Claims, 3 Drawing Sheets

STRINGED RACKET TENSIONING MECHANISM

TECHNICAL FIELD

This application relates to the field of stringed rackets and more particularly to the field of tensioning mechanisms for adjusting string tension in rackets used in games such as tennis, badminton, and squash.

BACKGROUND OF THE INVENTION

A multitude of racket string tensioning systems for tennis rackets are known. For example, DE 38 18 152 A1 shows a tennis racket with a string tensor attached via a gas spring element to the racket grip. The gas spring element causes middle longitudinal strings of the racket to exhibit an essentially constant string tension, even with an elongation of the strings. However, a tensioning mechanism of this kind is relatively costly to produce, has a non-negligible weight, and is susceptible to various difficulties. It is doubtful whether this tensioning device is practical under the extensive stress of normal play.

DE 38 13 872 C2 and DE 39 17 868 C2 disclose conventional tightening mechanisms which increase the circumference of the racket frame in the area of the racket heart. This tensioning mechanism causes a continuous tensioning of all racket strings. However, the split racket frame used in connection with this mechanism is relatively unstable compared to a conventional, single piece, racket frame.

SUMMARY OF THE INVENTION

An object of the invention is to adjust tension of strings of a stringed racket in a cost effective, efficient, and relatively trouble-free manner without having to first loosen the strings and without adding a weighty device that could destabilize the racket.

According to the present invention, a tensioning mechanism for adjusting string tension of a stringed racket includes an abutment piece with a central region and a first set of openings distributed circumferentially with respect to a frame of the stringed racket along the central region and includes a tensioning piece with a second set of openings corresponding to the first set of openings. The tensioning piece is held against the abutment piece by tensile strain of strings of the stringed racket and is adjustable into one of a plurality of resting positions where different ones of the resting positions adjust the string tension. The abutment piece can include at least one locking channel and at least one detent and the tensioning piece can include at least one locking tab and at least one contact surface. The locking channel can cooperate with the locking tab and the detent can cooperate with the contact surface to maintain the tensioning piece in a particular one of the resting positions. The locking tab can be formed by a lower longitudinal edge of the tensioning piece and the contact surface can be formed by a lateral lower area of a portion of the tensioning piece that faces the abutment piece.

The abutment piece can rest against the frame of the racket and can be arranged in a heart portion of the racket to operate on central strings of the racket. The tensioning piece can include a pair of catch holes at each end of the tensioning piece. The catch holes can be configured to accept two pegs of a cocking lever. The openings can be funnel shaped. Synthetic collars can be placed in the first set of openings and can be fixedly attached to the abutment piece.

In operation, the mechanism can be adjusted to a first resting position corresponding to a minimum string tension and then adjusted to a higher string tension in response to the strings experiencing a decline in string tension due to usage. It is also possible to first adjust the mechanism to a first resting position corresponding to a medium amount of string tension and then adjust the mechanism to a second resting position corresponding to a higher string tension or to a lower string tension depending on the changing demands of the player.

The simple, low-cost, and lightweight tensioning mechanism with variable locking positions allow reliable variation of string tension in distinct gradations. In a preferred embodiment of the invention, the locking channels in the detents are arranged on the abutment and at least one locking tab and at least one contact surface are arranged on the tensing component. As a result, the locking tab is formed by the lower longitudinal edge of the tensing piece and the contact surface is formed by an area of the underside of the tensing piece which lies opposite the lower longitudinal side. As can be appreciated by one of ordinary skill in the art, the detents or the locking grooves can be arranged on the tensing piece without essentially changing the mode of operation of the tensing mechanism. The abutment piece can be firmly integrated in the racket frame, for example, when the frame consists of carbon-fiber reinforced synthetic material. In order to retrofit the tensioning mechanism on a conventional racket, it is possible to fashion the abutment piece as a separate piece which can be joined to the racket frame. In that case, both portions of the tensioning mechanism are held on the racket by string tension.

Since the longest ones of the racket strings are subjected to greatest absolute stress during play, it is appropriate to let the tensioning mechanism operate on the longest strings. Moreover, it is advantageous not to attach the tensioning mechanism to an exposed area of the circumference of the racket frame, since this could create a source of potential injury. Therefore, the tensioning mechanism is advantageously arranged within the heart of the racket between the two V-shaped struts that connect the grip to the racket frame. The tensioning piece can be placed against a lower section of the racket frame. Tilting of the tensioning piece to adjust string tension can be brought about by any one of a variety of suitable means such as, for example, pliers. Advantageously, however, the tensioning piece can be configured with two catch holes at each end thereof in which two pegs of a cocking lever can be inserted. The cocking lever can be tilted with a much lower force than the force of the string tension.

In order not to wear out the strings by rubbing the strings against sharp-edged metal rims of the openings, it is advantageous to expand the openings to a funnel shape and to locate the funnel-shaped portions of openings opposite each other. In addition, the openings can be lined with synthetic collars. The collars can also be attached to the abutment piece or the tensioning piece. By attaching the synthetic collars to the abutment piece, the collars can guide the abutment piece on the racket frame, thereby eliminating the need for sidewalls on the abutment piece.

The tensioning mechanism can be operated in a variety of different manners. For a recreational player, it can be sufficient to arrange the tensioning piece in a position of minimum tension when the racket strings are placed on the racket so that as the tension of the strings decreases during use, the player can increase the string tension by engaging the tensioning piece in a position of next higher string tension. For a more advanced player who is interested in adjusting the string tension to adapt the racket to conditions of the day and to different playing situations, it is possible to first set the tensioning mechanism to a medium tension setting and then subsequently increasing or decreasing the tension during play, as appropriate.

DETAILED DESCRIPTION OF THE PREFERRED EMBODIMENTS

Figure 1:
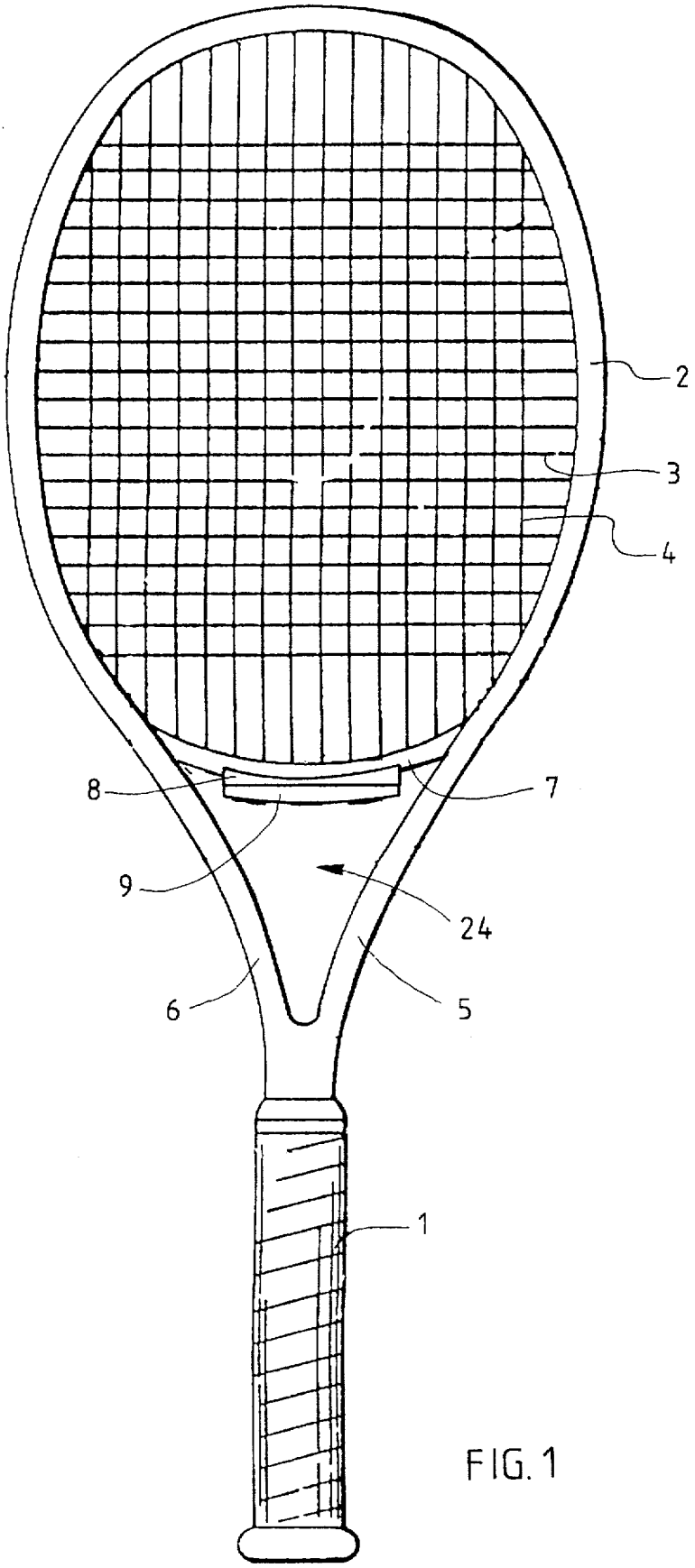
FIG. 1 shows a tennis racket with a tensioning mechanism according to the present invention.

Referring to FIG. 1, a tennis racket includes a racket grip 1 and a racket frame 2. The racket frame 2 is provided with lateral strings 3 and longitudinal strings 4. Conventionally, the strings 3, 4 can be in fact comprised of a single continuous piece of string that is wound around the frame 2. The racket grip 1 is joined with the racket frame 2 by way of two V-shaped struts 5, 6 connected to the racket frame 2. A lower frame section 7 is connected between points at which the struts 5, 6 are attached to the racket frame 2. A tensioning mechanism, consisting of an abutment piece 8 and a tensioning piece 9, fits against the lower frame section 7. Middle ones of the longitudinal strings 4 go through both pieces 8, 9 and are pulled against the lower frame section 7 by the string tension conveyed by the middle ones of the longitudinal strings 4. In the embodiment shown in FIG. 1, the tensioning mechanism is arranged within a heart portion 24 of the racket.

Figure 2:
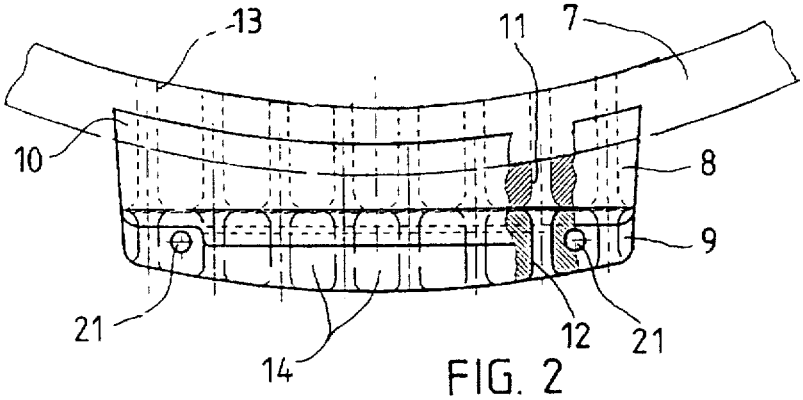
FIG. 2 is a top, enlarged, view of an embodiment of the tensioning mechanism according to the present invention.
Figure 3:
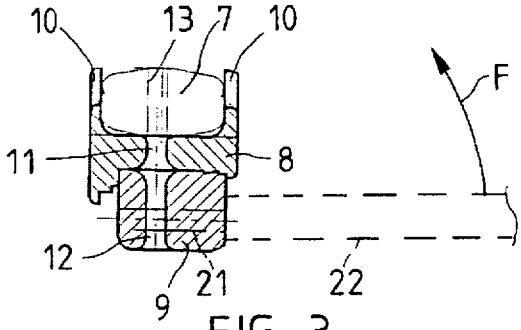
FIG. 3 is a side view of the tensioning mechanism of FIG. 2 in cross-section showing a cocking lever represented by a dotted line.

The construction and operation of the tensioning mechanism is illustrated in FIGS. 2, 3 and 4*a*–4*c*. The lower frame section 7 is indicated in FIGS. 2 and 3 by thin lines. The abutment piece 8, which fits against the lower frame section 7, has side walls 10 which laterally envelop the lower frame section 7. The abutment piece 8 and the tensioning piece 9 have openings 11, 12 for accepting the middle ones of the longitudinal strings 4 of the racket. The openings 11, 12 are substantially aligned with openings 13 of the lower frame section 7. A spacing segment 14 is located between two adjacent ones of the openings 12 of the tensioning piece 9. The middle ones of the longitudinal strings 4 are wrapped around the spacing segment 14 so that the tensioning piece 9 and the abutment piece 8 are held firmly against the racket frame section 7.

Figure 4A:
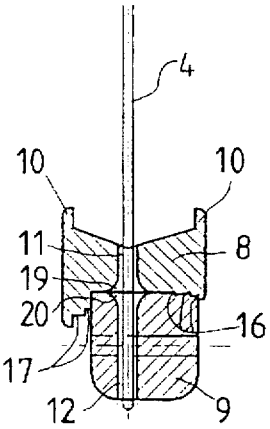
FIGS. 4*a*, 4*b* and 4*c* show the tensioning mechanism of FIGS. 2 and 3 in three different locking positions.
Figure 4B:
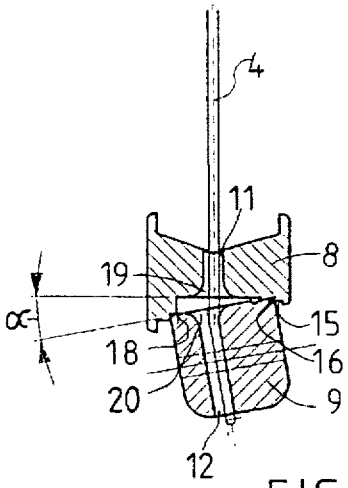
Figure 4C:
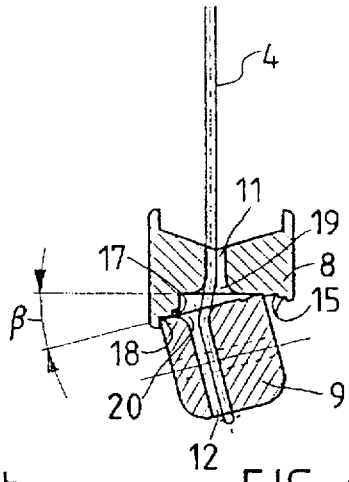

The operation of the tensioning mechanism is shown in FIGS. 4*a*–4*c*. One side of the abutment piece 8 has three locking grooves 15. The tensioning piece 9 has three locking tabs 16. One of the locking tabs 16 corresponds to a lateral longitudinal edge of the tensioning piece 9. Note that it is possible to achieve reliable engaging by using just the lateral longitudinal edge of the tensioning piece 9 as a locking tab. The additional locking tabs 16 illustrated in connection with this embodiment provide an additional safeguard against unintentional adjustment of the tensioning mechanism.

A plurality of detents 17 are located on another side of the abutment piece 8. The detents 17 work in concert with a contact surface 18 formed by the lateral area of a portion of the tensioning piece 8 facing the abutment piece.

In a first, lowest, tension position shown in FIG. 4*a*, an underside portion of the tensioning piece 9 rests substantially flush against an opposing surface of the abutment piece 8. In a second position shown in FIG. 4*b*, the tensioning piece is tilted at an angle of $\alpha$ and locked in the second position. The longitudinal edge of the tensioning piece 9, which corresponds to one of the locking tabs 16, engages the middle one of the locking grooves 15. The contact surface 18 of the tensioning piece 9 rests on a middle one of the detents 17. Because the tensioning piece 9 is tilted in relation to the abutment piece 8, the middle ones of the longitudinal strings 4 are stretched and tension of all of the strings is thereby increased.

FIG. 4*c* illustrates the tensioning mechanism in a greatest tension position where one of the locking tabs 16 of the tensioning piece 9 engages in an innermost one of the locking grooves 15 and the contact surface 18 of the tensioning piece 9 rests on a highest one of the detents 17 of the abutment piece 8. The tensioning piece 9 is inclined at an angle of $\beta$ with respect to the abutment piece 8.

In the course of tilting the tensioning piece 9 in relation to the abutment piece 8, the middle ones of the longitudinal strings 4 could rub against the rim areas of the openings 11, 12 of the abutment piece 8 and the tensioning piece 9. In order to prevent the middle ones of the longitudinal strings 4 from being damaged by edges of the openings 11, 12, the apertures 19, 20 of opposing ones of the openings 11, 12 can have a funnel-like shape.

Two catch holes 21, located at each end of the tensioning piece 9, can be used for swiveling the tensioning piece 9 in relation to the abutment piece 8. Engagement pegs, shown in FIG. 3 by a dotted line, can be inserted into the catch holes 21. The pegs can be connected to each other by, for example, a U-shaped bracket. A cocking lever 22 engages the engagement pegs to allow the tensioning piece 9 to be easily titled by hand by applying a force, F, to the cocking lever 22. The catch holes 21 do not necessarily have to be perpendicular to the racket face, but can also, for example, run parallel to it, in which case the engagement pegs would be appropriately angled with respect to the cocking lever 22.

Figure 5:
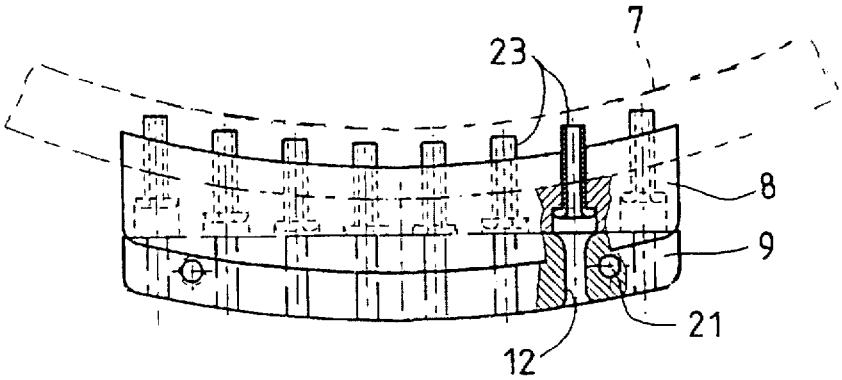
FIG. 5 is a top view showing a different embodiment of the tensioning mechanism according to the present invention.
Figure 6A:
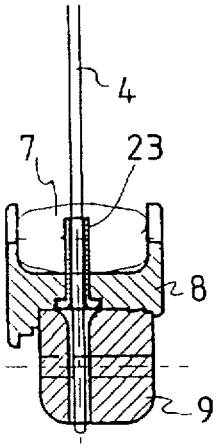
FIGS. 6*a*, 6*b* and 6*c* are cross-sectional lateral views of the tensioning mechanism of FIG. 5 in three different locking positions.
Figure 6B:
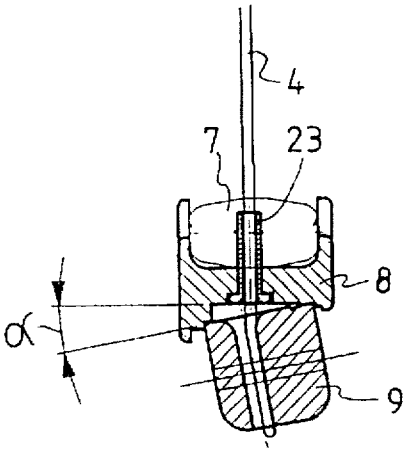
Figure 6C:
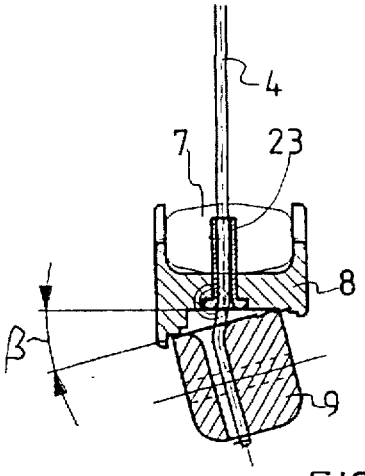

FIG. 5 shows an alternative embodiment of the tensioning mechanism, where the abutment piece 8 includes synthetic collars 23 for the protection of the middle ones of the longitudinal strings 4 that pass through the abutment piece 8. Since the tensioning mechanism can be made of light metal such as aluminum, the synthetic collars 23 can prevent excessive wear of the middle ones of the longitudinal strings 4 that would be caused by rubbing against a metallic portion of the mechanism. In addition, synthetic collars can also be provided for the openings 12 in the tensioning piece 9. FIGS. 6*a*–6*c* illustrate different operative states of the embodiment of the tensioning mechanism 9 of FIG. 5 and correspond to the FIGS. 4*a*–4*c*, respectively, described above.

Figure 7:
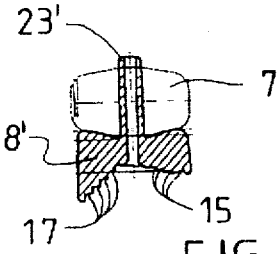
FIG. 7 is a cross-sectional lateral view of a different embodiment of an abutment piece of the tensioning mechanism according to the present invention.

FIG. 7 shows an alternative embodiment including an alternative abutment piece 8'. The abutment piece 8' can be made of glass-reinforced or carbon-fiber reinforced synthetic material and have alternative synthetic collars 23' attached thereto so that the collar 23' and abutment piece 8' form a single unit. In the case of the embodiment shown in FIG. 7, the synthetic collars 23' guide the abutment piece 8' in the openings of the lower frame section 7 of the racket, so that the side walls shown in connection with the embodiments of the previous figures are not needed.

Although the invention is illustrated herein in connection with a tennis racket, one of ordinary skill in the art can appreciate that the invention can be used in connection with other types of stringed rackets, such as squash rackets and badminton rackets.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A stringed racket and tensioning mechanism for adjusting string tension of the stringed racket, comprising:

an abutment piece, having a central region and having a first set of openings distributed circumferentially with respect to a frame of the stringed racket along said central region; and a tensioning piece, having a second set of openings corresponding to said first set of openings, said tensioning piece being held against said abutment piece by tensile strain of strings of the stringed racket and being adjustable into one of a plurality of resting positions, wherein different ones of said resting positions adjust the string tension.

2. A stringed racket and tensioning mechanism, according to claim 1, wherein said abutment piece includes at least one locking channel and at least one detent and said tensioning piece includes at least one locking tab and at least one contact surface, and wherein said at least one locking channel cooperates with said at least one locking tab and said at least one detent cooperates with said at least one contact surface to maintain said tensioning piece in a particular one of said resting positions.

3. A stringed racket and tensioning mechanism, according to claim 2, wherein said at least one locking tab is formed by a lower longitudinal edge of said tensioning piece and said at least one contact surface is formed by a lateral lower area of a portion of said tensioning piece that faces said abutment piece.

4. A stringed racket and tensioning mechanism, according to claim 3, wherein said abutment piece rests against the frame of the racket.

5. A stringed racket and tensioning mechanism, according to claim 4, wherein said abutment piece and said tensioning piece are arranged in a heart portion of the racket and operate on central strings of the racket.

6. A stringed racket and tensioning mechanism, according to claim 5, wherein said openings are funnel shaped.

7. A stringed racket and tensioning mechanism, according to claim 1, wherein said abutment piece rests against the frame of the racket.

8. A stringed racket and tensioning mechanism, according to claim 1, wherein said abutment piece and said tensioning piece are arranged in a heart portion of the racket and operate on central strings of the racket.

9. A stringed racket and tensioning mechanism, according to claim 1, wherein said tensioning piece includes a pair of catch holes at each end configured to accept two pegs of a cocking lever.

10. A stringed racket and tensioning mechanism, according to claim 1, wherein said openings are funnel shaped.

11. A stringed racket and tensioning mechanism, according to claim 1, wherein synthetic collars are placed in said first set of openings.

12. A stringed racket and tensioning mechanism, according to claim 8, wherein said synthetic collars are attached to said abutment piece.

13. A stringed racket and tensioning mechanism, according to claim 9, wherein said abutment piece rests against the frame of the racket.

14. A stringed racket and tensioning mechanism, according to claim 13, wherein said abutment piece and said tensioning piece are arranged in a heart portion of the racket and operate on central strings of the racket.

15. A stringed racket and tensioning mechanism, according to claim 14, wherein said tensioning piece includes a pair of catch holes at each end configured to accept two pegs of a cocking lever.

16. A stringed racket and tensioning mechanism, according to claim 15, wherein said openings are funnel shaped.

17. A stringed racket and tensioning mechanism, according to claim 16, wherein synthetic collars are placed in said first set of openings.

18. A stringed racket and tensioning mechanism, according to claim 17, wherein said synthetic collars are attached to said abutment piece.

19. A tensioning mechanism for adjusting string tension, comprising:

an abutment piece, having a central region and having a first set of openings distributed along said central region; and a tensioning piece, having a second set of openings corresponding to said first set of openings, said tensioning piece being positioned against said abutment piece and being adjustable into one of a plurality of resting positions, wherein different ones of said resting positions adjust the string tension.

20. A tensioning mechanism, according to claim 19, wherein said abutment piece includes at least one locking channel and at least one detent aid tensioning piece includes at least one locking tab and at least one contact surface, and wherein said at least one locking channel cooperates with said at least one locking tab and said at least one detent cooperates with said at least one contact surface to maintain said tensioning piece in a particular one of said resting positions.

21. A tensioning mechanism, according to claim 20, wherein said at least one locking tab is formed by a lower longitudinal edge of said tensioning piece and said at least one contact surface is formed by a lateral lower area of a portion of said tensioning piece that faces said abutment piece.

22. A tensioning mechanism, according to claim 21, wherein said abutment piece and said tensioning piece are configured to be arranged in a heart portion of the racket and operate on central strings of the racket.

23. A tensioning mechanism, according to claim 21, wherein said tensioning piece includes a pair of catch holes at each end configured to accept two pegs of a cocking lever.

24. A method of adjusting string tension of a stringed racket using a tensioning mechanism having an abutment piece with a central region and a first set of openings distributed circumferentially with respect to a frame of the stringed racket along the central region and having a tensioning piece with a second set of openings corresponding to the first set of openings, where the tensioning piece is held against the abutment piece by tensile strain of strings of the stringed racket and is adjustable into one of a plurality of resting positions where different ones of the resting positions adjust the string tension, the method comprising the steps of:

a first step of adjusting the mechanism to a first resting position corresponding to minimum string tension; and following said first step, a second step of adjusting the mechanism to a second resting position corresponding to a next higher string tension in response to the strings experiencing a decline in string tension.

25. A method of adjusting string tension of a stringed racket using a tensioning mechanism having an abutment piece with a central region and a first set of openings distributed circumferentially with respect to a frame of the stringed racket along the central region and having a tensioning piece with a second set of openings corresponding to the first set of openings, where the tensioning piece is held against the abutment piece by tensile strain of strings of the stringed racket and is adjustable into one of a plurality of resting positions where different ones of the resting positions adjust the string tension, the method comprising the steps of:

a first step of adjusting the mechanism to a first resting position corresponding to a medium amount of string tension; and following said first step, a second step of adjusting the mechanism to a second resting position corresponding to one of: a higher string tension and a lower string tension.

* * * * *